US010811794B2

(12) United States Patent
Annis et al.

(10) Patent No.: US 10,811,794 B2
(45) Date of Patent: Oct. 20, 2020

(54) CARD EDGE CONNECTOR SYSTEM

(71) Applicant: TE CONNECTIVITY CORPORATION, Berwyn, PA (US)

(72) Inventors: Kyle Gary Annis, Hummelstown, PA (US); Kevin Michael Thackston, York, PA (US); Andrew Monroe Martin, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/867,998

(22) Filed: Jan. 11, 2018

(65) Prior Publication Data

US 2019/0214754 A1 Jul. 11, 2019

(51) Int. Cl.

| | |
|---|---|
| ***H01R 12/72*** | (2011.01) |
| ***H01R 13/621*** | (2006.01) |
| ***H01R 13/24*** | (2006.01) |
| ***H01R 12/73*** | (2011.01) |
| *H01R 13/533* | (2006.01) |

(52) U.S. Cl.
CPC ..... *H01R 12/721* (2013.01); *H01R 12/73* (2013.01); *H01R 13/2492* (2013.01); *H01R 13/621* (2013.01); *H01R 13/533* (2013.01)

(58) Field of Classification Search
CPC ..... H01R 12/721; H01R 13/621
USPC ..... 439/326
See application file for complete search history.

(56) References Cited

U.S. PATENT DOCUMENTS

| | | | | | |
|---|---|---|---|---|---|
| 3,543,226 | A * | 11/1970 | Bernard | H01R 12/721 | 439/637 |
| 3,920,302 | A * | 11/1975 | Cutchaw | H01R 12/88 | 439/188 |
| 3,941,448 | A * | 3/1976 | Evans | H01R 12/79 | 439/493 |
| 3,980,377 | A * | 9/1976 | Oxley | H01R 12/87 | 439/637 |
| 4,087,151 | A * | 5/1978 | Robert | H01R 23/70 | 200/51.1 |
| 4,106,841 | A * | 8/1978 | Vladic | H01R 23/70 | 439/188 |
| 4,118,094 | A * | 10/1978 | Key | H01R 12/87 | 439/327 |

(Continued)

FOREIGN PATENT DOCUMENTS

| | | |
|---|---|---|
| EP | 2696440 A1 | 2/2014 |
| EP | 3179572 A1 | 6/2017 |
| GB | 1501255 A | 2/1978 |

OTHER PUBLICATIONS

Annex to European Search Report, dated May 15, 2019, EP 19 15 0811, Application No. 19150811.8-1201.

*Primary Examiner* — Edwin A. Leon
*Assistant Examiner* — Milagros Jeancharles

(57) ABSTRACT

A card edge connector includes a housing having a mounting end mounted to a host circuit board and a mating end having a card slot receiving a circuit card. Upper and lower contacts are received in upper and lower contact channels of the housing. The upper and lower contacts include corresponding mounting ends and mating ends with the mounting ends mounted to the host circuit board and the mating ends having first and second mating interfaces defining first and second points of contact with the same contact pad of the circuit card.

19 Claims, 7 Drawing Sheets

(56) References Cited

U.S. PATENT DOCUMENTS 4,324,451 A * 4/1982 Ammon ..... H01R 12/58 439/637
4,514,030 A * 4/1985 Triner ..... H01R 12/721 439/188
4,705,338 A * 11/1987 Sitzler ..... H01R 12/89 439/260
4,708,095 A * 11/1987 Luterek ..... F01P 9/00 123/41.42
5,071,371 A * 12/1991 Harwath ..... H01R 12/721 439/60
5,147,214 A * 9/1992 Korsunsky ..... H01R 12/83 439/326
5,162,002 A * 11/1992 Regnier ..... H01R 12/721 439/157
5,186,643 A * 2/1993 Bakke ..... H01R 12/83 439/326
5,203,725 A * 4/1993 Brunker ..... H01R 12/83 439/636
5,240,420 A * 8/1993 Roberts ..... H01R 12/714 439/493
5,277,607 A * 1/1994 Thumma ..... H01R 12/721 439/188
5,292,265 A * 3/1994 Chen ..... H01R 12/83 439/876
5,336,117 A * 8/1994 Mizuguchi ..... H01R 12/721 439/374
5,425,651 A * 6/1995 Thrush ..... H01R 12/83 439/326
5,514,002 A * 5/1996 Cheng ..... H01R 12/721 439/326
5,676,559 A * 10/1997 Laub ..... H01R 12/62 439/260
5,695,354 A * 12/1997 Noda ..... H01R 12/716 439/326
5,725,389 A * 3/1998 Scheer ..... H01R 12/7005 439/328
5,769,668 A * 6/1998 Tondreault ..... H01R 12/7005 439/326
5,863,213 A * 1/1999 Enomoto ..... H01R 12/83 439/326
6,015,310 A * 1/2000 Tojo ..... H01R 12/592 439/260
6,149,468 A * 11/2000 Meng ..... H01R 12/82 439/637
6,231,364 B1 * 5/2001 Liu ..... H01R 12/83 361/801
6,322,370 B1 * 11/2001 Hart ..... H01R 13/658 439/108
6,482,041 B1 11/2002 Yu-Feng
6,712,624 B2 * 3/2004 Hashimoto ..... H01R 12/714 439/633
6,764,345 B1 * 7/2004 Duesterhoeft ..... H01R 12/721 439/637
7,114,975 B2 * 10/2006 Liao ..... H01R 12/7005 439/326
7,134,896 B1 * 11/2006 Chen ..... H05K 7/1404 439/326
8,690,589 B2 * 4/2014 Ngo ..... H01R 12/7052 439/630
9,022,811 B2 * 5/2015 Takaki ..... H01R 12/70 439/637
9,033,750 B2 * 5/2015 Miller ..... H01R 13/26 439/862
9,318,850 B2 * 4/2016 Li ..... H01R 12/721
9,401,554 B2 * 7/2016 Takane ..... H01R 12/79
10,135,165 B2 * 11/2018 Zuo ..... H01R 12/721
2005/0062556 A1 * 3/2005 Aronson ..... H01R 23/688 333/33
2005/0164540 A1 * 7/2005 Korsunsky ..... H05K 7/142 439/328
2007/0086710 A1 * 4/2007 Takizawa ..... H01R 12/721 385/88
2007/0099470 A1 * 5/2007 Yang ..... H05K 7/1404 439/326
2007/0105425 A1 * 5/2007 Wang ..... H05K 7/142 439/326
2011/0021080 A1 * 1/2011 Kamiya ..... H01R 12/721 439/637
2011/0140136 A1 * 6/2011 Daily ..... H01R 12/721 257/89
2011/0151701 A1 * 6/2011 Ngo ..... H01R 13/6273 439/327
2011/0165783 A1 * 7/2011 Tracy ..... H05K 1/142 439/61
2011/0263146 A1 * 10/2011 Su ..... H01R 12/7029 439/153
2011/0300760 A1 * 12/2011 Ngo ..... H01R 12/7011 439/636
2013/0109240 A1 * 5/2013 Chiang ..... H01R 12/7029 439/630
2013/0237092 A1 * 9/2013 Rubens ..... H01R 13/6596 439/607.23
2013/0288534 A1 * 10/2013 Degner ..... H01R 12/721 439/630
2014/0045383 A1 * 2/2014 Fujii ..... H01R 12/79 439/630
2014/0051294 A1 2/2014 Miller et al.
2014/0080343 A1 * 3/2014 Wang ..... H01R 12/721 439/325

* cited by examiner

CARD EDGE CONNECTOR SYSTEM

BACKGROUND OF THE INVENTION

The subject matter herein relates generally to card edge connector systems.

Card edge connector systems are known that include the circuit cards configured to be mated with the card edge connectors. However, known card edge connector systems fail to meet environmental and mechanical requirements for certain applications, such as military and aerospace applications, where the components are subjected to harsh environments. For example, some applications may subject the components to vibration during use. Vibration causes wear on the contacts and may lead to unintentional loss of contact. Additionally, the circuit card may cause damage to the card edge connector, such as the contacts of the card edge connector, when the circuit card moves relative to the card edge connector. As connector components are made smaller for certain applications, size constraints make electrical connection between the contacts and the circuit card difficult to achieve.

A need remains for a rugged card edge connector system.

BRIEF DESCRIPTION OF THE INVENTION

In one embodiment, a card edge connector is provided including a housing having a mounting end configured to be mounted to a host circuit board and a mating end having a card slot configured to receive a circuit card. The housing has an upper wall above the card slot and a lower wall below the card slot. The upper wall has upper contact channels and the lower wall has lower contact channels. Upper contacts are received in the upper contact channels and lower contacts are received in the lower contact channels. The upper contacts include corresponding mounting ends and mating ends with the mounting ends extending from the housing for mounting to the host circuit board and the mating ends having a first mating interface and a second mating interface remote from the first mating interface. The first and second mating interfaces of the upper contacts define first and second points of contact with the same contact pad on an upper surface of the circuit card. The lower contacts include corresponding mounting ends and mating ends with the mounting ends extending from the housing for mounting to the host circuit board and the mating ends having a first mating interface and a second mating interface remote from the first mating interface. The first and second mating interfaces of the lower contacts define first and second points of contact with the same contact pad on a lower surface of the circuit card.

In another embodiment, a card edge connector system is provided including a circuit card having a mating end including a mating edge between an upper surface and a lower surface and having upper contact pads on the upper surface and lower contact pads on the lower surface. The card edge connector system includes a card edge connector configured to be mounted to a host circuit board. The card edge connector includes a housing having a card slot receiving the circuit card. The housing holds upper contacts and lower contacts configured to be terminated to the host circuit board. The upper contacts have mating ends mated with corresponding upper contact pads having a first mating interface and a second mating interface remote from the first mating interface defining first and second points of contact with the same upper contact pad. The lower contacts have mating ends mated with corresponding lower contact pads having a first mating interface and a second mating interface remote from the first mating interface defining first and second points of contact with the same lower contact pad. The circuit card is received in the card slot of the housing in a loading direction angled non-parallel to the host circuit board to a loaded position. The circuit card is rotated in a mating direction within the card slot toward the host circuit board to a mated position. The circuit card is held in the card slot in the mated position with the circuit card extending from the housing parallel to the host circuit board.

In a further embodiment, a card edge connector system includes a circuit card having a mating end including a mating edge between an upper surface and a lower surface having upper contact pads on the upper surface and lower contact pads on the lower surface and having a fastener opening extending therethrough. The card edge connector system includes a card edge connector configured to be mounted to a host circuit board. The card edge connector includes a housing having a card slot receiving the circuit card and having a fastener opening proximate to the card slot. The housing holds upper contacts and lower contacts configured to be terminated to the host circuit board. The upper contacts have mating ends mated with corresponding upper contact pads having a first mating interface and a second mating interface remote from the first mating interface defining first and second points of contact with the same upper contact pad. The lower contacts have mating ends mated with corresponding lower contact pads having a first mating interface and a second mating interface remote from the first mating interface defining first and second points of contact with the same lower contact pad. The circuit card is secured to the housing of the card edge connector using a fastener received in the fastener openings in the circuit card and the housing to fix the circuit card to the housing.

DETAILED DESCRIPTION OF THE INVENTION

Figure 1:
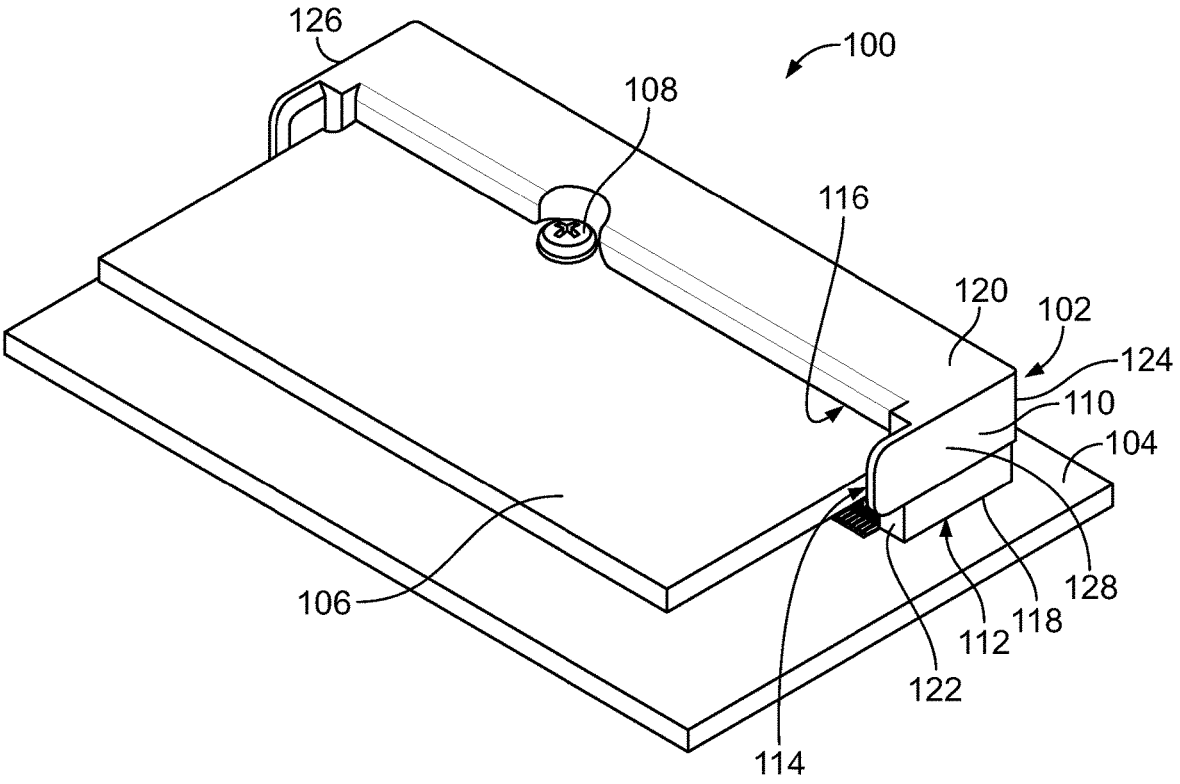
FIG. 1 is a perspective view of a card edge connector system in accordance with an exemplary embodiment.

FIG. 1 is a perspective view of a card edge connector system 100 in accordance with an exemplary embodiment. The card edge connector system 100 includes a card edge connector 102 mounted to a host circuit board 104. The card edge connector system 100 includes a circuit card 106 coupled to the card edge connector 102. In an exemplary embodiment, the circuit card 106 is secured to the card edge connector 102 using a fastener 108. The fastener 108 retains the circuit card 106 in the card edge connector 102. The fastener 108 reduces relative movement between the circuit card 106 and the card edge connector 102, such as during vibration of the card edge connector system 100 making a robust electrical connection between the components and reducing wear on the components.

The card edge connector 102 includes a housing 110 having a mounting end 112 mounted to the host circuit board 104 and a mating end 114 having a card slot 116 that receives the circuit card 106. In the illustrated embodiment, the mounting end 112 is provided at a bottom 118 of the housing 110. The housing 110 includes a top 120 opposite the bottom 118. In the illustrated embodiment, the mating end 114 is provided at a front 122 of the housing 110. The housing 110 includes a rear 124 opposite the front 122. In an exemplary embodiment, the housing 110 extends between a first side 126 and a second side 128. In the illustrated embodiment, the fastener 108 is approximately centered between the first and second sides 126, 128. However, in alternative embodiments, the card edge connector system 100 may include a plurality of fasteners 108, such as proximate to the first and second sides 126, 128.

Figure 2:
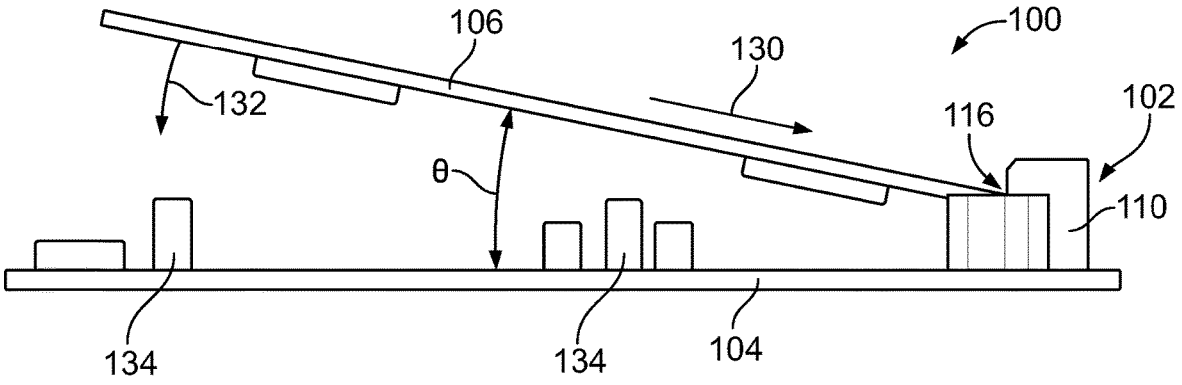
FIG. 2 is a side view of the card edge connector system in accordance with an exemplary embodiment.

FIG. 2 is a side view of the card edge connector system 100 in accordance with an exemplary embodiment. FIG. 2 illustrates the circuit card 106 be loaded into the card edge connector 102. In an exemplary embodiment, the circuit card 106 is loaded into the card edge connector 102 at an angle rather than be loaded straight into the card edge connector 102. For example, the circuit card 106 is loaded into the card edge connector 102 in a loading direction 130 angled nonparallel to the host circuit board 104. The circuit card 106 is configured to be rotated in a mating direction 132 within the card slot 116 toward the host circuit board 104 to a mated position (shown in FIG. 1). In the mated position, the circuit card 106 extends from the housing 110 generally parallel to the host circuit board. As such, the circuit card 106 is loaded into the housing 110 at an angle relative to the final mated position of the circuit card 106.

Optionally, the card edge connector system 100 may include standoffs 134 on the host circuit board 104. The standoffs 134 may support the circuit card 106 in the mated position. The standoffs 134 hold the circuit card 106 elevated above the host circuit board 104 such that a space is formed between the circuit card 106 and the host circuit board 104. Other components may occupy the space. For example, electrical components mounted to the host circuit board 104 or the bottom side of the circuit card 106 may be positioned in the space between the circuit card 106 and the host circuit board 104. Loading of the circuit card 106 into the housing 110 at the angled loading direction 130 ensures that the components do not interfere with loading the circuit card 106 into the card edge connector 102.

Figure 3:
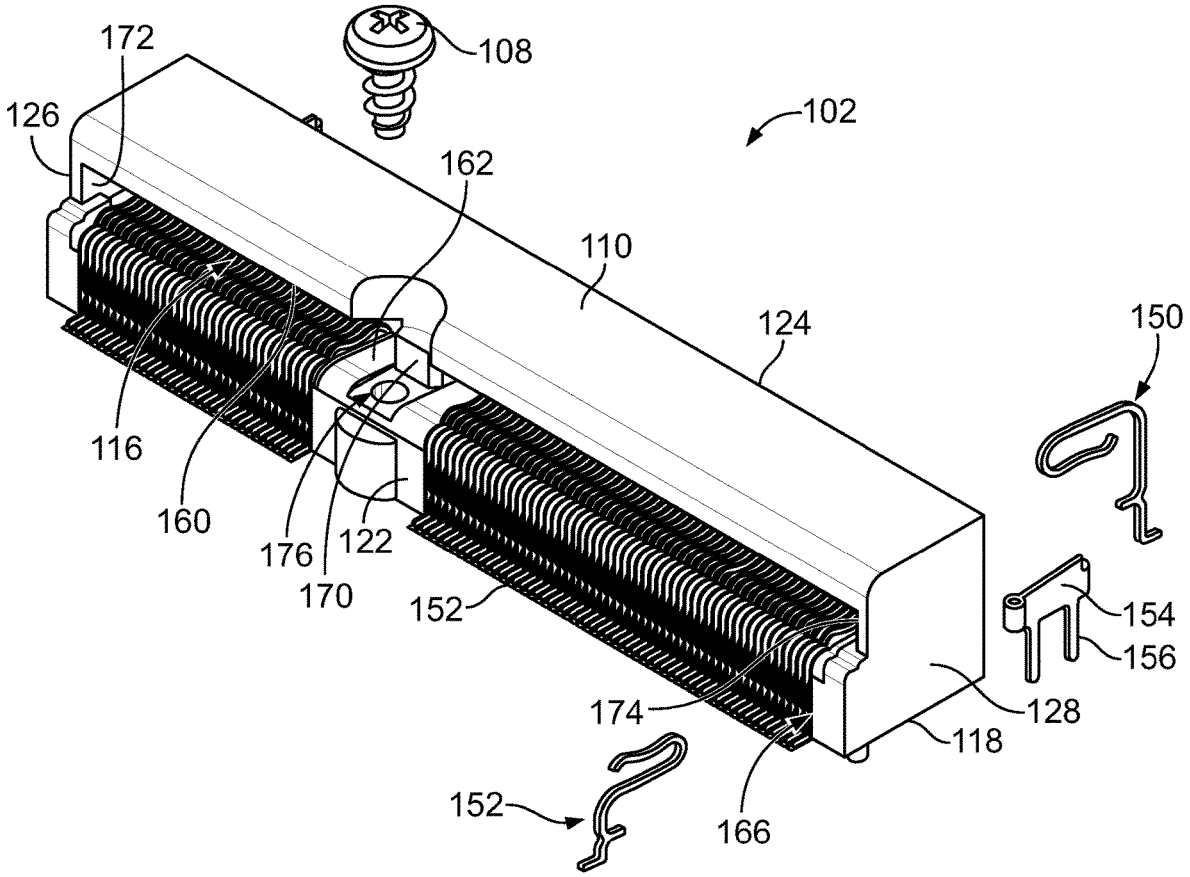
FIG. 3 is a perspective view of a card edge connector of the card edge connector system in accordance with an exemplary embodiment.

FIG. 3 is a perspective view of the card edge connector 102 in accordance with an exemplary embodiment. The card edge connector 102 includes a plurality of upper contacts 150 arranged in a row along the upper side of the card slot 116 and a plurality of lower contacts 152 arranged in a row along the lower side of the card slot 116. The upper contacts 150 are held in the housing 110 for mating with the circuit card 106 and the host circuit board 104. The lower contacts 152 are held in the housing 110 for mating with the circuit card 106 and the host circuit board 104. In an exemplary embodiment, the upper contacts 150 are configured to be mounted to the housing 110 at the rear 124 and the lower contacts 152 are configured to be mounted to the housing 110 at the front 122. Other arrangements are possible in alternative embodiments.

In an exemplary embodiment, the card edge connector 102 includes mounting tabs 154 used for mounting the housing 110 to the host circuit board 104. The mounting tabs 154 may be received in the bottom 118 of the housing 110 proximate to the first and second sides 126, 128. The mounting tabs 154 may be held in the housing 110 by an interference fit. The mounting tabs 154 have mounting legs 156 configured to be mounted to the host circuit board 104. For example, the mounting legs 156 may be solder legs configured to be soldered to the host circuit board 104. The mounting legs 156 may extend into the vias in the host circuit board 104 or may be surface mounted to the host circuit board 104.

The housing 110 includes an upper wall 160 above the card slot 116 and a lower wall 162 below the card slot 116. The upper contacts 150 may extend along the upper wall 160 and the lower contacts 152 may extend along the lower wall 162. In an exemplary embodiment, the upper wall 160 includes upper contact channels 164 (shown in FIG. 8) that receive corresponding upper contacts 150. The lower wall 162 includes lower contact channels 166 that receive corresponding lower contacts 152.

In an exemplary embodiment, the housing 110 includes a mid-wall 170 between first and second side walls at the first and second sides 126, 128, respectively. The sidewalls 172, 174 are provided at opposite sides of the card slot 116. The mid-wall 170 divides the card slot 116 into card slot portions. A first set of upper and lower contacts 150, 152 may be provided between the mid-wall 170 and the first side wall 172 and a second set of upper and lower contacts 150, 152 may be provided between the mid-wall 170 and the second side wall 174. In an exemplary embodiment, the mid-wall 170 is used to locate the circuit card 106 in the card slot 116. For example, the circuit card 106 may engage one or more sides of the mid-wall 170 to locate the circuit card 106 in the card slot 116. Optionally, the front edge of the mid-wall 170 may be chamfered to help guide loading of the circuit card 106 into the card slot 116.

Optionally, the housing 110 includes a fastener opening 176 that receive the fastener 108. The fastener opening 176 may be threaded. Optionally, the fastener opening 176 may be aligned with the mid-wall 170. Other locations are possible in alternative embodiments, such as at the first side wall 172 and/or the second side wall 174.

Figure 4:
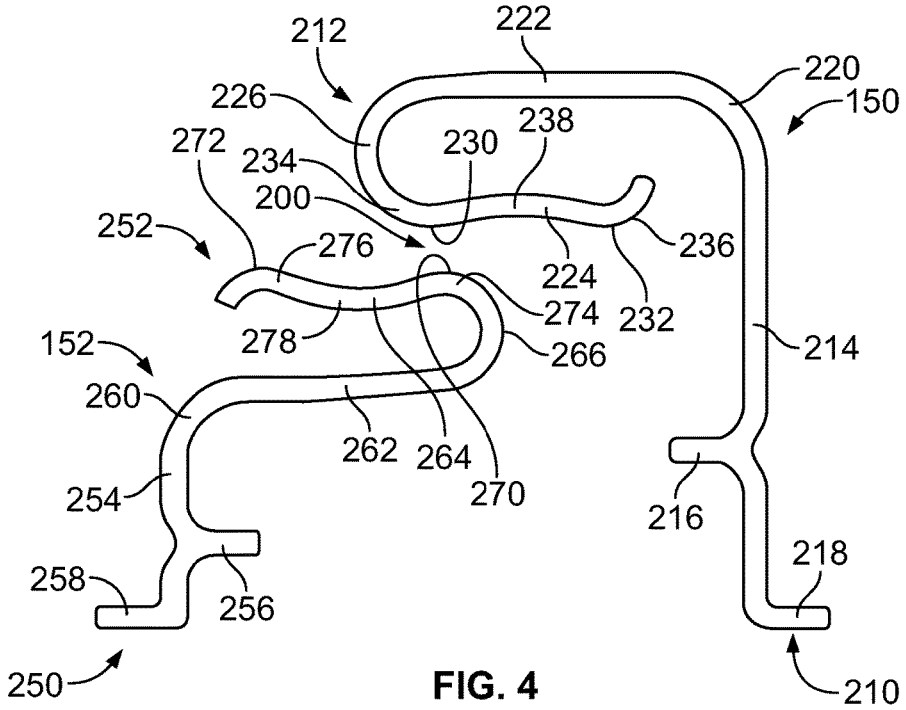
FIG. 4 is a side view of a portion of the card edge connector showing upper and lower contacts in accordance with an exemplary embodiment.

FIG. 4 is a side view of a portion of the card edge connector 102 showing the upper contact 150 and the lower contact 152 with the housing 110 removed. A receiving space 200 is defined between the upper contact 150 and lower contact 152 for receiving the circuit card 106. In an exemplary embodiment, the upper and lower contacts 150, 152 are stamped contacts stamped into the shapes illustrated in FIG. 4. By stamping the contacts into the predetermined shapes, the contacts may be manufactured in a repeatable manner, such as compared to contacts that are formed by bending into the predetermined shape.

The upper contact 150 includes a mounting end 210 and a mating end 212 opposite the mounting end 210. The mounting end 210 is configured to be mounted to the host circuit board 104. The mating end 212 is configured to be mated with the circuit card 106. The upper contact 150 includes a base 214 between the mounting end 210 and the mating end 212. In the illustrated embodiment, the base 214 extends generally vertically; however, the base 214 may extend in other directions in alternative embodiments. The base 214 includes a mounting post 216 used to secure the upper contact 150 to the housing 110. In the illustrated embodiment, the mounting post 216 is forward facing.

In the illustrated embodiment, the mounting end 210 includes a solder tail 218 configured to be soldered to the host circuit board 104. In the illustrated embodiment, the solder tail 218 extends horizontally from the base 214. The solder tail 218 is provided at the bottom of the upper contact 150. Other types of mounting ends 210 may be provided in alternative embodiments, such as a compliant pin configured to be press-fit into the host circuit board 104.

The mating end 212 is cantilevered from the base 214 and extends forward of the base 214. For example, the mating end 212 extends from the base 214 at a corner 220. The mating end 212 includes a support arm 222 and the spring arm 224 extending from the support arm 222. The support arm 222 is provided at the top of the upper contact 150. In an exemplary embodiment, the spring arm 224 is folded under the support arm 222 at a front bend 226. The support arm 222 may extend generally horizontally and the spring arm 224 may extend generally horizontally below the support arm 222; however, the spring arm 224 may be angled nonparallel relative to the support arm 222. The spring arm 224 is deflectable relative to the support arm 222, such as at the front bend 226. The support arm 222 is deflectable relative to the base 214, such as at the corner 220.

In an exemplary embodiment, the upper contact 150 includes a first mating interface 230 and a second mating interface 232 remote from the first mating interface 230. The first and second mating interfaces 230, 232 define first and second points of contact configured to engage the same contact pad on the upper surface of the circuit card 106. In the illustrated embodiment, the first mating interface 230 is provided proximate to the front of the spring arm 224 and the second mating interface 232 is provided proximate to the rear of the spring arm 224. For example, the first mating interface 230 may be defined by a front bulge 234 and the second mating interface 232 may be defined by a rear bulge 236 along the spring arm 224. A shallow 238 may be defined between the front and rear bulges 234, 236. The bulges 234, 236 are located vertically lower than the shallow 238 to define the first and second points of contact with the circuit card 106. The spring arm 224 is deflectable and may be deflected when engaging the circuit card 106.

In an exemplary embodiment, the upper contact 150 has a higher spring rate at the first mating interface 230 and a lower spring rate at the second mating interface 232. For example, the upper contact 150 may be stiffer at the first mating interface 230 and may be more flexible at the second mating interface 232. Having different spring rates ensures that both mating interfaces 230, 232 engage and are spring loaded against the circuit card 106 when mated thereto.

The lower contact 152 includes a mounting end 250 and a mating end 252 opposite the mounting end 250. The mounting end 250 is configured to be mounted to the host circuit board 104. The mating end 252 is configured to be mated with the circuit card 106. The lower contact 152 includes a base 254 between the mounting end 250 and the mating end 252. In the illustrated embodiment, the base 254 extends generally vertically; however, the base 254 may extend in other directions in alternative embodiments. The base 254 includes a mounting post 256 used to secure the lower contact 152 to the housing 110. In the illustrated embodiment, the mounting post 256 is rearward facing.

In the illustrated embodiment, the mounting end 250 includes a solder tail 258 configured to be soldered to the host circuit board 104. In the illustrated embodiment, the solder tail 258 extends horizontally from the base 254. The solder tail 258 is provided at the bottom of the lower contact 152. Optionally, the solder tail 258 may be coplanar with the solder tail 218. Other types of mounting ends 250 may be provided in alternative embodiments, such as a compliant pin configured to be press-fit into the host circuit board 104.

The mating end 252 is cantilevered from the base 254 and extends rearward of the base 254. For example, the mating end 252 extends from the base 254 at a corner 260. The mating end 252 includes a support arm 262 and the spring arm 264 extending from the support arm 262. The spring arm 264 is provided at the top of the lower contact 152. In an exemplary embodiment, the spring arm 264 is folded over the support arm 262 at a rear bend 266. The support arm 262 may extend generally horizontally and the spring arm 264 may extend generally horizontally above the support arm 262; however, the spring arm 264 may be angled nonparallel relative to the support arm 262. The spring arm 264 is deflectable relative to the support arm 262, such as at the rear bend 266. The support arm 262 is deflectable relative to the base 254, such as at the corner 260.

In an exemplary embodiment, the lower contact 152 includes a first mating interface 270 and a second mating interface 272 remote from the first mating interface 270. The first and second mating interfaces 270, 272 define first and second points of contact configured to engage the same contact pad on the lower surface of the circuit card 106. In the illustrated embodiment, the first mating interface 270 is provided proximate to the rear of the spring arm 264 and the second mating interface 272 is provided proximate to the front of the spring arm 264. For example, the first mating interface 270 may be defined by a front bulge 274 and the second mating interface 272 may be defined by a rear bulge 276 along the spring arm 264. A shallow 278 may be defined between the front and rear bulges 274, 276. The bulges 274, 276 are located vertically higher than the shallow 278 to define the first and second points of contact with the circuit card 106. The spring arm 264 is deflectable and may be deflected when engaging the circuit card 106.

In an exemplary embodiment, the lower contact 152 has a higher spring rate at the first mating interface 270 and a lower spring rate at the second mating interface 272. For example, the lower contact 152 may be stiffer at the first mating interface 270 and may be more flexible at the second mating interface 272. Having different spring rates ensures that both mating interfaces 270, 272 engage and are spring loaded against the circuit card 106 when mated thereto.

Figure 5:
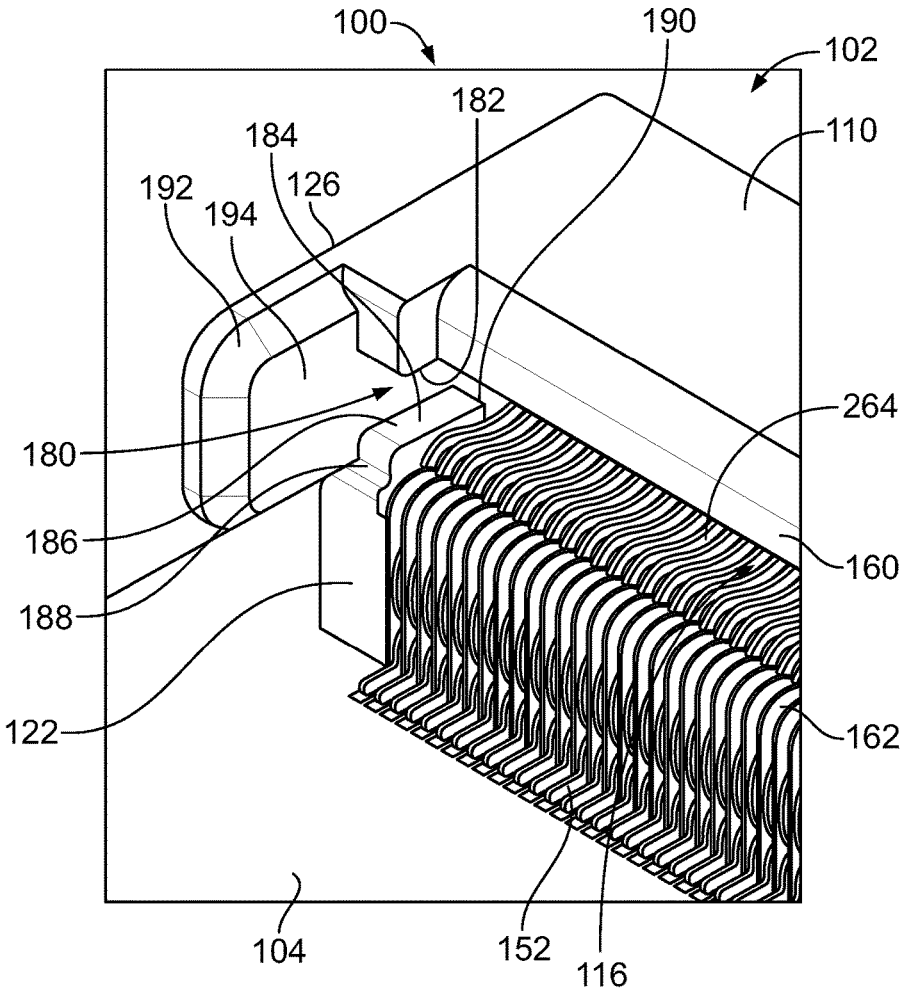
FIG. 5 is a perspective view of a portion of the card edge connector system in accordance with an exemplary embodiment.

FIG. 5 is a perspective view of a portion of the card edge connector system 100 showing the first side 126 of the card edge connector 102. In an exemplary embodiment, the housing 110 includes guide channels 180 for guiding loading of the circuit card 106 into the card slot 116. The guide channel 180 is defined by an upper guide surface 182 and a lower guide surface 184. The guide channel 180 may be angled for loading the circuit card 106 in the loading direction 130 (shown in FIG. 2). For example, the guide channel 180 may be angled nonparallel to the host circuit board 104 The upper guide surface 182 may form part of the upper wall 160 and the lower guide surface 184 may form part of the lower wall 162.

In an exemplary embodiment, the housing 110 includes guide pads 186 along with the lower wall 162. The guide pad 186 may form part of the lower guide surface 184. The guide pad 186 is configured to lift the circuit card 106 upward off of the lower wall 162 during loading of the circuit card 106 into the card slot 116. The guide pad 186 positions the circuit card 106 above the lower wall 162 to alleviate stress on the lower contacts 152. The guide pad 186 may prevent damage to the lower contacts 152 during loading. In the illustrated embodiment, the guide pad 186 is provided at the front of the card slot 116. The guide pad includes a lead-in surface 188 at a front of the guide pad 186. The lead-in surface 188 may be curved or raft to transition the circuit card 106 to the upper guide surface 182 along the top of the guide pad 186. If the circuit card 106 is being loaded into the card slot 116 to low, the circuit card 106 engages the lead-in surface 188 and the lifted upward on to the guide pad 186 and guided into the card slot 116. The guide pad 186 is provided forward of the spring arms 264 of the lower contacts 152 to lift the circuit card 106 over the spring arms 264 of the lower contacts 152. The guide pads 186 prevent damage to the lower contacts 152. For example, the guide pads 186 prevent the edge of the circuit card 106 from bottoming out against the distal ends of the spring arms 264 and thus prevent buckling or bending of the lower contacts 152. A rear end 190 of the guide pad 186 drops downward into the guide channel 180 to allow the circuit card 106 to lower into the lower contacts 152 for mating to the lower contacts 152.

Optionally, the housing 110 may include guide wings 192 extending forward from the front 122 of the housing 110. The guide wings 192 extend forward of the guide channel 180. The guide wings 192 have interior surfaces 194 that are configured to engage the circuit card 106 and align the circuit card 106 with the card slot 116. The guide wings 192 prevent loading of the circuit card 106 askew. The guide wings 192 ensure that the circuit card 106 is loaded straight into the card slot 116 and is not over rotated in either direction.

Figure 6:
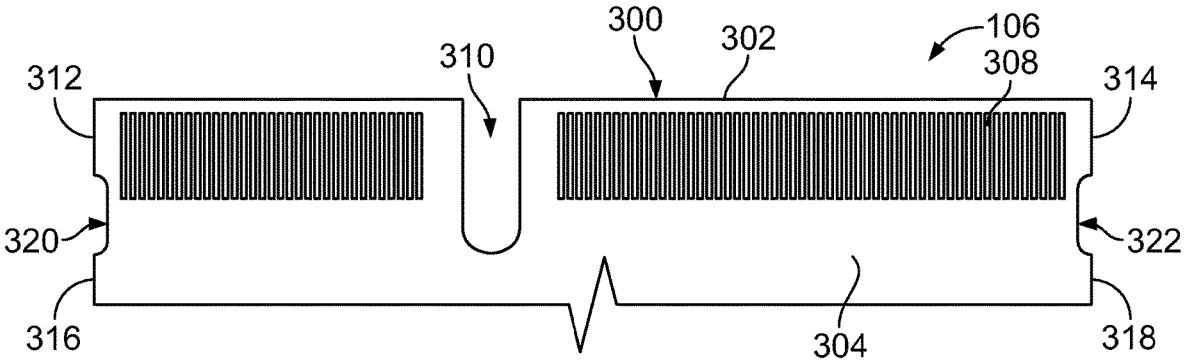
FIG. 6 is a top view of a circuit card of the card edge connector system in accordance with an exemplary embodiment.

FIG. 6 is a top view of the circuit card 106 in accordance with an exemplary embodiment. The circuit card 106 includes a mating end 300 having a mating edge 302 between an upper surface 304 and an opposite lower surface 306 (shown in FIG. 9). The circuit card 106 includes contact pads 308 on the upper surface 304 and the lower surface 306. The contact pads 308 on the upper surface 304 may be referred to hereinafter as upper contact pads and the contact pads 308 on the lower surface 306 be referred to hereinafter as lower contact pads. The contact pads 308 are provided proximate to the mating edge 302. The contact pads 308 are configured to be electrically connected to the upper and lower contacts 150, 152.

In an exemplary embodiment, the circuit card 106 includes an alignment slot 310 for aligning the circuit card 106 in the card slot 116. The alignment slot 310 is configured to receive the mid-wall 170 (shown in FIG. 3). Optionally, the alignment slot 310 defines a fastener opening 310 configured to receive the fastener 108 (shown in FIG. 1). Alternatively, the circuit card 106 may include a separate fastener opening that receives the fastener 108. In an exemplary embodiment, the circuit card 106 includes guide tabs 312, 314 at opposite first and second sides 316, 318 of the circuit card 106. The guide tabs 312, 314 are configured to be received in the guide channels 180 (shown in FIG. 5). In an exemplary embodiment, the guide tabs 312, 314 are configured to engage the guide pads 186 (shown in FIG. 5) for positioning the circuit card 106 in the card slot 116. The circuit card 106 includes pockets 320, 322 rearward of the guide tabs 312, 314, respectively. The circuit card 106 is narrower at the pockets 320, 322 and wider at the guide tabs 312, 314. The pockets 320, 322 are configured to receive the guide pads 186 when the circuit card 106 is fully loaded into the card edge connector 102.

Figure 7:
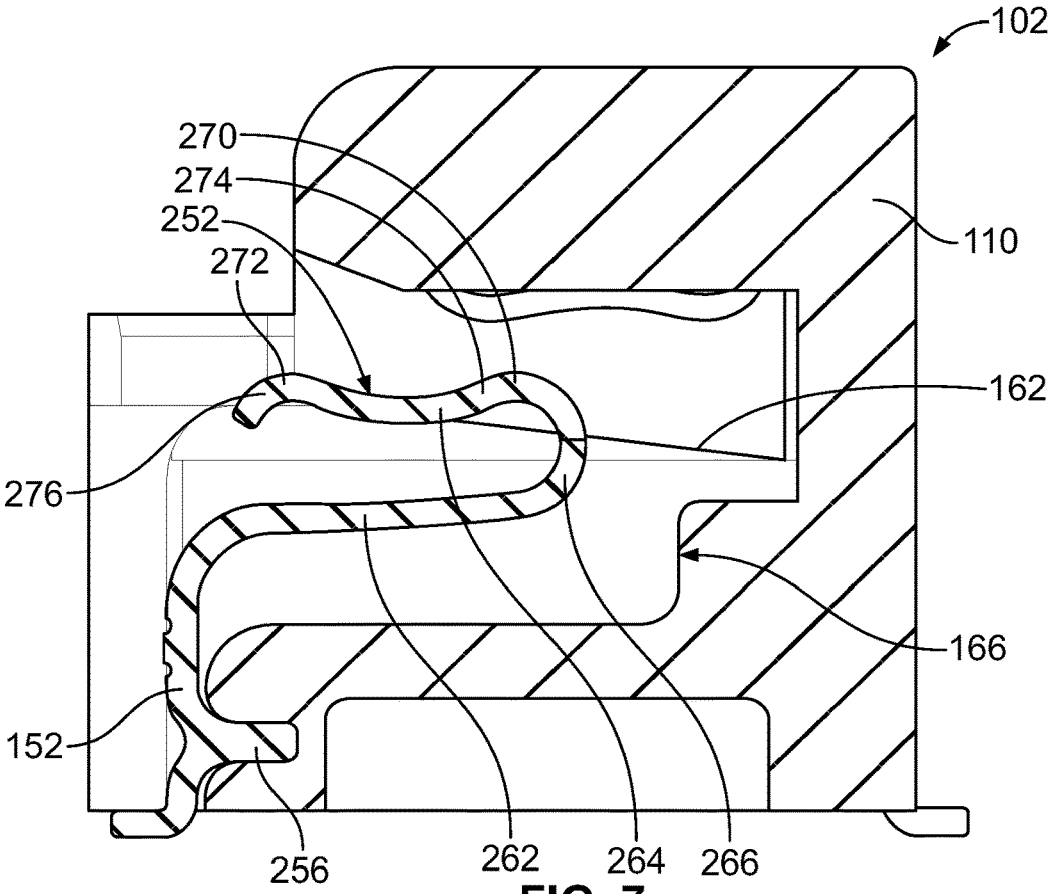
FIG. 7 is a cross-sectional view of the card edge connector showing one of the lower contacts in accordance with an exemplary embodiment.

FIG. 7 is a cross-sectional view of the card edge connector 102 showing one of the lower contacts 152 loaded into the housing 110. The lower contact 152 is received in the lower contact channel 166. The mounting post 256 is loaded into an opening in the housing 110. The mounting post 256 may be secured by an interference fit. The mounting post 216 may include barbs or other features to retain the lower contact 152 in the housing 110. The support arm 262 and the spring arm 264 are positioned in the lower contact channel 166 such that portions of the spring arm 264 are exposed above the lower wall 162 for mating with the circuit card 106. For example, the bulges 274, 276 are exposed above the lower wall 162 for mating with the circuit card 106. The first and second mating interfaces 270, 272 define multiple points of contact with the circuit card 106.

In an exemplary embodiment, the lower contact channel 166 is oversized to allow space for the lower contact 152 to deflect when mated with the circuit card 106. For example, space is provided below the support arm 264 to allow the support arm 264 to deflect downward. Space is provided behind the rear band 266 to allow deflection of the mating end 252.

Figure 8:
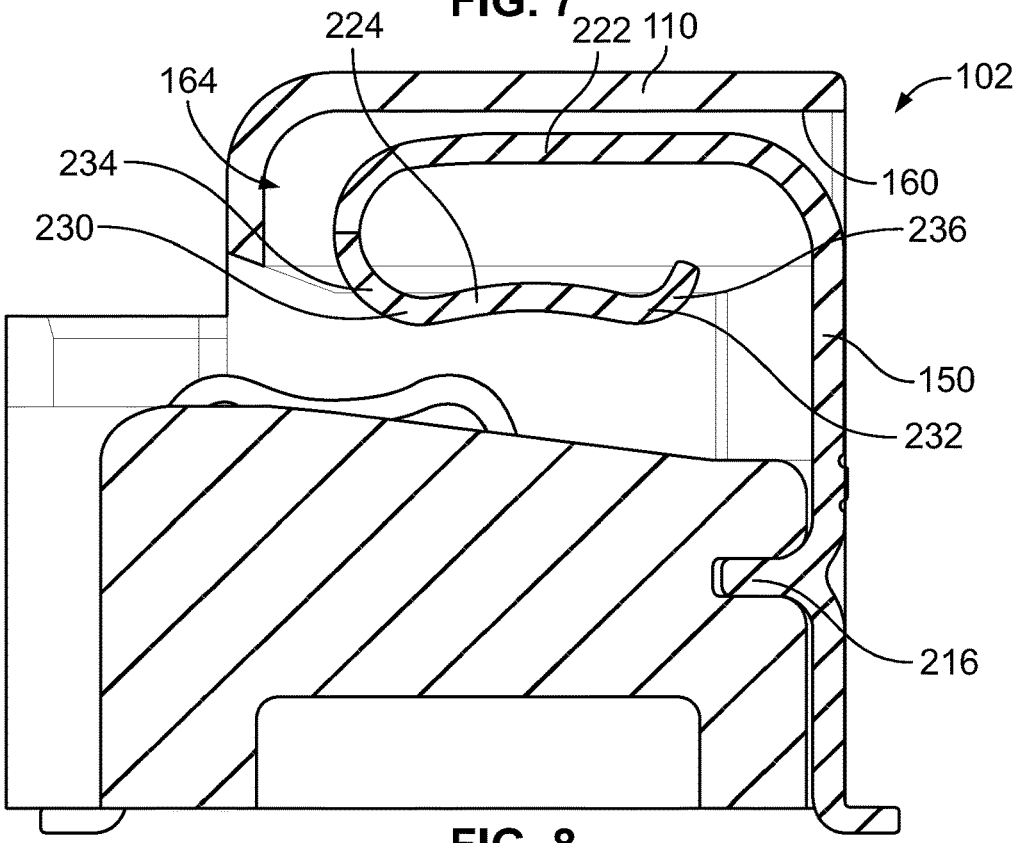
FIG. 8 is a cross-sectional view of the card edge connector showing one of the upper contacts in accordance with an exemplary embodiment.

FIG. 8 is a cross-sectional view of the card edge connector 102 showing one of the upper contacts 150 loaded into the housing 110. The upper contact 150 is received in the upper contact channel 164. The mounting post 216 is loaded into an opening in the housing 110. The mounting post 216 may be secured by an interference fit. The mounting post 216 may include barbs or other features to retain the upper contact 150 in the housing 110. The support arm 222 and the spring arm 224 are positioned in the upper contact channel 164 such that portions of the spring arm 224 are exposed below the upper wall 160 for mating with the circuit card 106. For example, the bulges 234, 236 are exposed below the upper wall 160 for mating with the circuit card 106. The first and second mating interfaces 230, 232 define multiple points of contact with the circuit card 106.

In an exemplary embodiment, the upper contact channel 164 is oversized to allow space for the upper contact 150 to deflect when mated with the circuit card 106. For example, space is provided above the support arm 224 to allow the support arm 224 to deflect upward.

Figure 9:
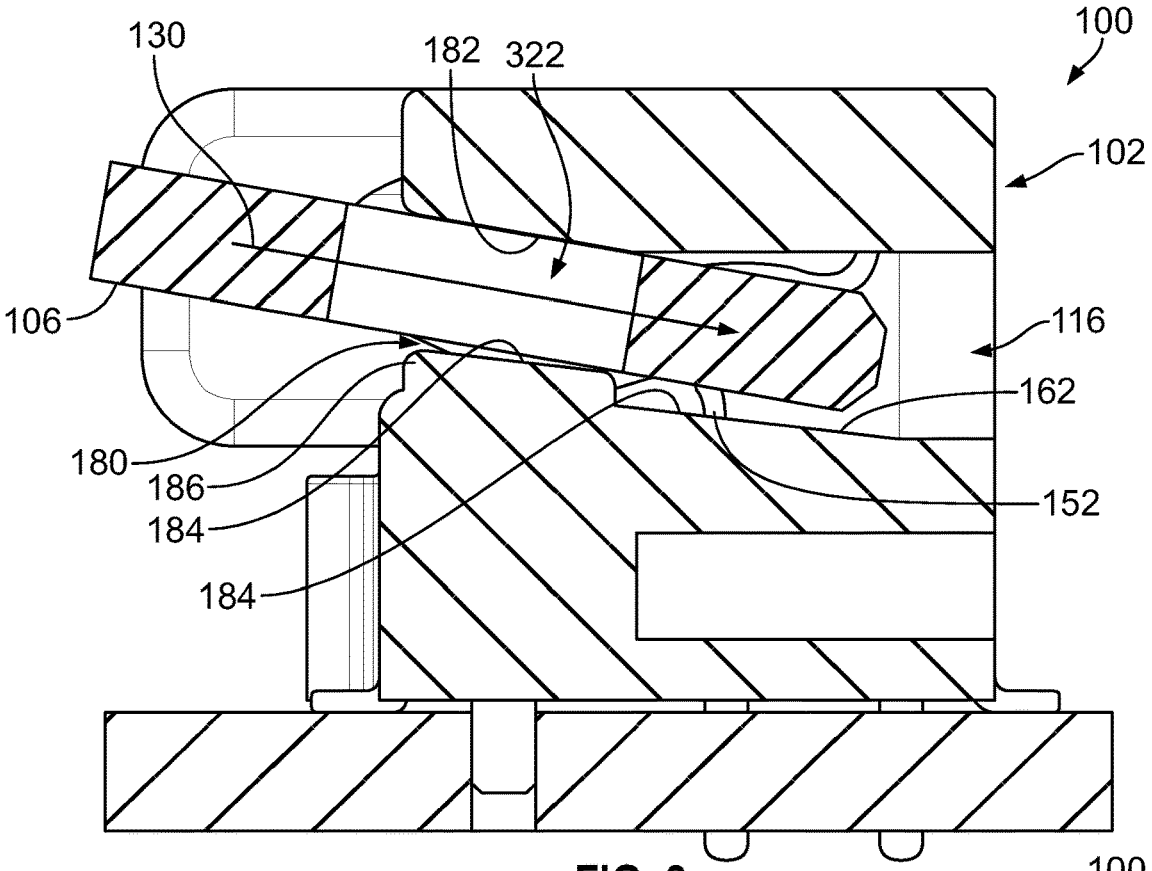
FIG. 9 is a cross-sectional view of a portion of the card edge connector system showing the circuit card being loaded into the card edge connector in accordance with an exemplary embodiment.
Figure 10:
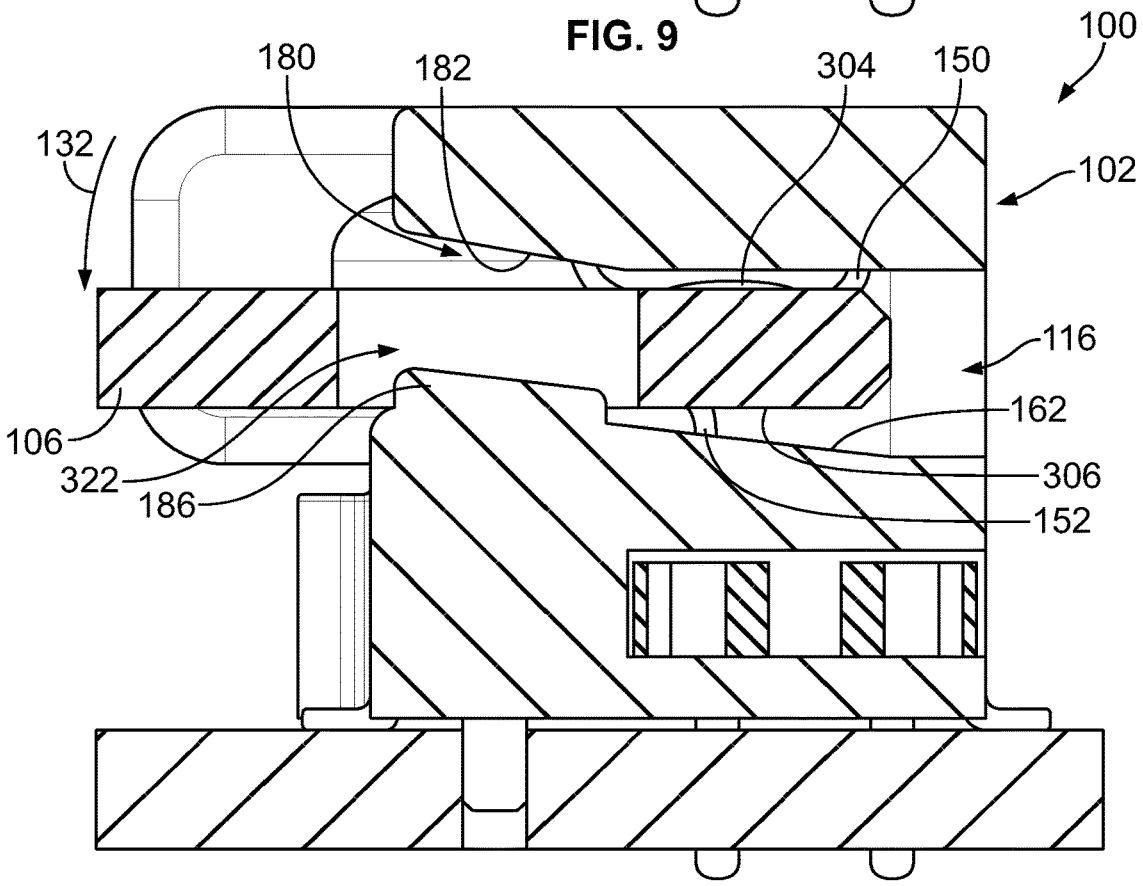
FIG. 10 is a cross-sectional view of a portion of the card edge connector system showing the circuit card in the card edge connector in a mated position in accordance with an exemplary embodiment.
Figure 11:
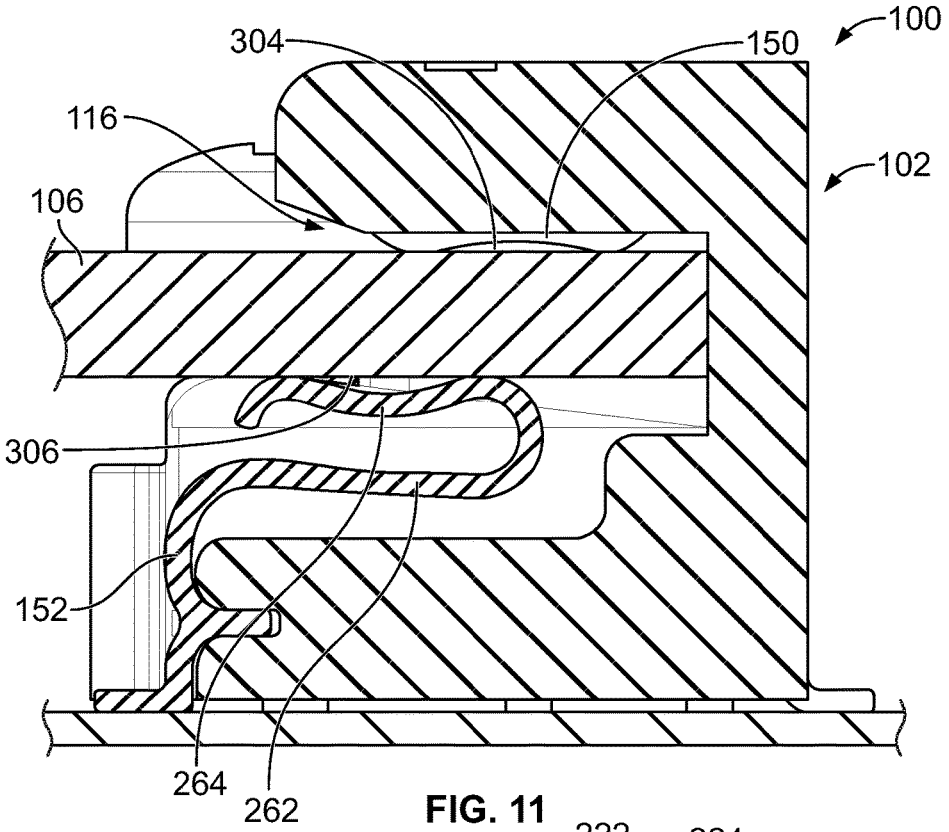
FIG. 11 is a cross-sectional view of a portion of the card edge connector system showing the circuit card in the card edge connector in a mated position in accordance with an exemplary embodiment.
Figure 12:
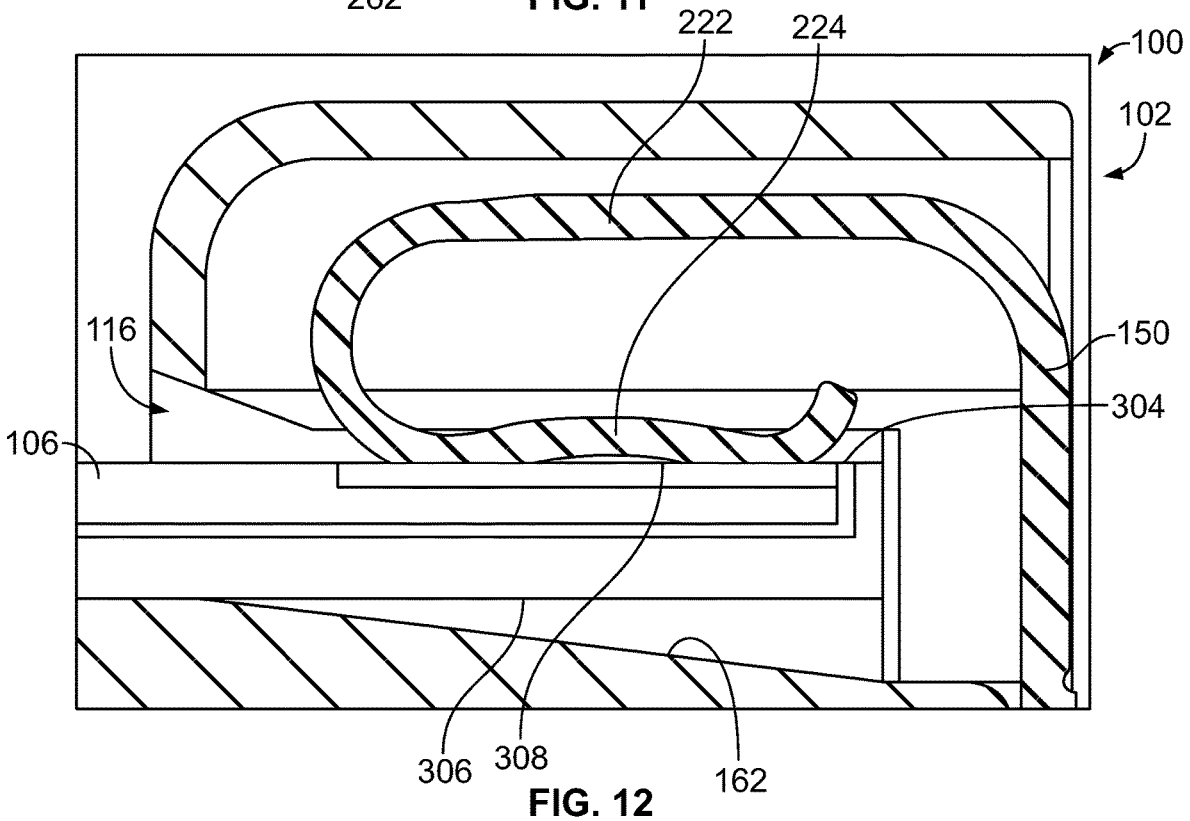
FIG. 12 is a cross-sectional view of a portion of the card edge connector system showing the circuit card in the card edge connector in a mated position in accordance with an exemplary embodiment.

FIG. 9 is a cross-sectional view of a portion of the card edge connector system 100 showing the circuit card 106 being loaded into the card edge connector 102 in the loading direction 130. FIG. 10 is a cross-sectional view of a portion of the card edge connector system 100 showing the circuit card 106 in the card edge connector 102 in a mated position. FIG. 11 is a cross-sectional view of a portion of the card edge connector system 100 showing the circuit card 106 in the card edge connector 102 in a mated position showing the lower contact 152 mated to the circuit card 106. FIG. 12 is a cross-sectional view of a portion of the card edge connector system 100 showing the circuit card 106 in the card edge connector 102 in a mated position showing the upper contact 150 mated to the circuit card 106.

During loading (FIG. 9), the circuit card 106 is guided into the card slot 116 by the guide channel 180. The guide channel 180 is defined by the upper guide surface 182 and the lower guide surface 184. In an exemplary embodiment, the guide surfaces 182, 184 may be angled to allow angled loading of the circuit card 106 into the card slot 116 along the angled loading direction 130. The guide channel 180 guides the circuit card 106 into the receiving space 200 between the upper and lower contacts 150, 152. When the circuit card 106 engages the upper contacts 150 and the lower contact 152, portions of the contacts 150, 152 may be deflected outward. For example, the spring arms 224, 264 may be deflected outward and/or the support arms 222, 262 may be deflected outward.

The guide pads 186 may define a portion of the lower guide surface 184. The guide pads 186 elevate the circuit card 106 off of the lower wall 162 to prevent damage to the lower contacts 152 during loading of the circuit card 106 into the card slot 116.

When the pockets 320, 322 are aligned with the guide pads 186 (FIG. 10), the circuit card 106 may be lowered into the card slot 116. For example, the lower surface 306 may be dropped below the guide pads 186 to position the circuit card 106 in the card slot 116. Once loaded into the card slot 116, the circuit card 106 may be lowered in the mating direction 132 to the mated position (FIG. 10). In the mated position, the circuit card 106 is oriented generally horizontally. As shown in FIG. 11, for example, the spring arm 224 of the upper contact 150 extends along the upper surface 304 for electrical connection with the corresponding contact pads 308 on the upper surface 304 of the circuit card 106. As shown in FIG. 12, for example, the spring arm 264 of the lower contact 152 extends along the lower surface 306 for electrical connection with the corresponding contact pads 308 on the lower surface 306 of the circuit card 106.

Figure 13:
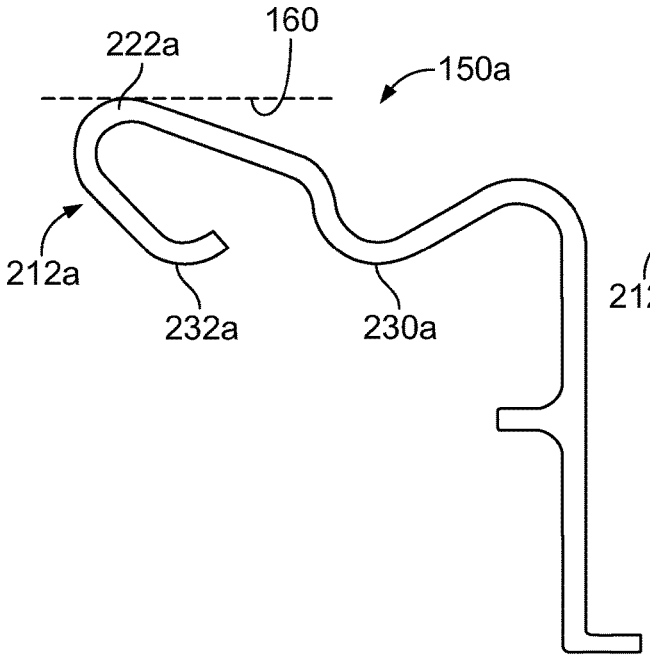
FIG. 13 is a side view of one of the upper contacts in accordance with an exemplary embodiment.

FIG. 13 is a side view of the upper contact 150*a* in accordance with an exemplary embodiment. The mating end 212*a* of the upper contact 150*a* is shaped differently than the embodiment illustrated in FIG. 4. The upper contact 150*a* includes the first and second mating interfaces 230*a*, 232*a* staggered relative to each other. The upper contact 150*a* includes the support arm 222*a* between the first and second mating interfaces 230*a*, 232*a*. The support arm 222*a* may engage the upper wall 160 (shown in phantom) to limit deflection of the upper contact 150*a*. As such, the first and second mating interfaces 230*a*, 232*a* may be independently movable with the support arm 224*a* fixed to the upper wall 160.

Figure 14:
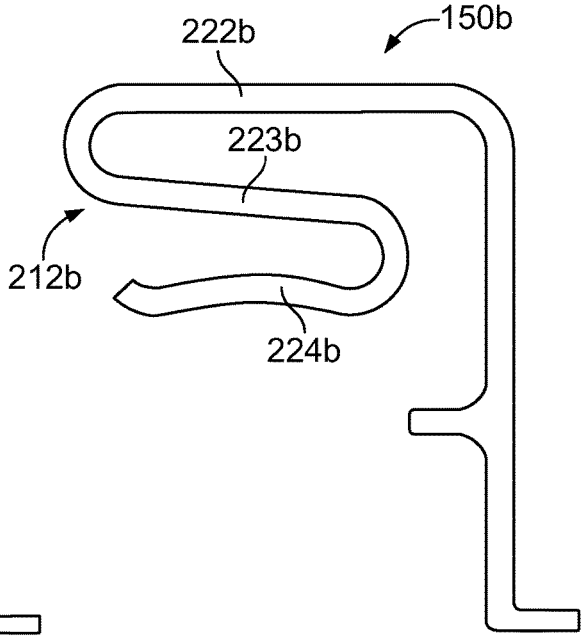
FIG. 14 is a side view of one of the upper contacts in accordance with an exemplary embodiment.

FIG. 14 is a side view of the upper contact 150*b* in accordance with an exemplary embodiment. The upper contact includes an intermediate section 223*b* between the support arm 222*b* and spring arm 224*b*. The intermediate section 223*b* adds additional length to the mating end 212*b* of the upper contact 150*b*. Additionally, the spring arm 224*b* extends forwardly rather than rearwardly.

Figure 15:
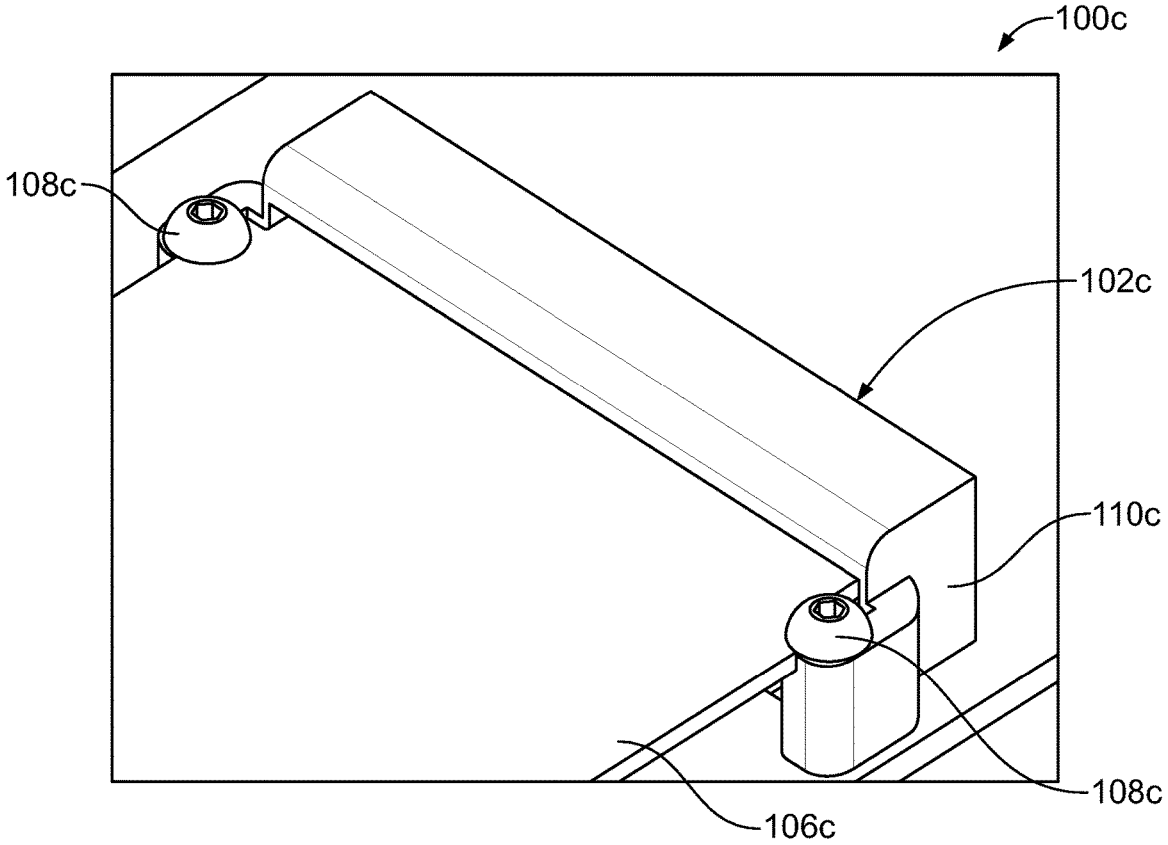
FIG. 15 is a perspective view of the card edge connector system in accordance with an exemplary embodiment.

FIG. 15 is a perspective view of the card edge connector system 100*c* in accordance with an exemplary embodiment. FIG. 15 illustrates the circuit card 106*c* being secured to the housing 110*c* of the card edge connector 102*c* using a pair of fasteners 108*c* at the first and second sides of the circuit card 106*c* rather than in a middle portion of the circuit card 106*c*. Other arrangements of the fasteners 108*c* are possible in alternative embodiments.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A card edge connector comprising:

a housing having a mounting end configured to be mounted to a host circuit board and a mating end having a card slot configured to receive a circuit card, the housing having an upper wall above the card slot and a lower wall below the card slot, the upper wall having upper contact channels, the lower wall having lower contact channels;

upper contacts received in the upper contact channels, the upper contacts including corresponding mounting ends and mating ends, the mounting ends of the upper contacts extending from the housing for mounting to the host circuit board, each mating end of the upper contacts having a first mating interface and a second mating interface non-continuous with the first mating interface and remote from the first mating interface, the first and second mating interfaces of the upper contacts defining first and second points of contact with the same contact pad on an upper surface of the circuit card, wherein the upper contact has a higher spring rate at the first mating interface and a lower spring rate at the second mating interface; and lower contacts received in the lower contact channels, the lower contacts including corresponding mounting ends and mating ends, the mounting ends of the lower contacts extending from the housing for mounting to the host circuit board, each mating end of the lower contacts having a first mating interface and a second mating interface non-continuous with the first mating interface and remote from the first mating interface, the first and second mating interfaces of the lower contacts defining first and second points of contact with the same contact pad on a lower surface of the circuit card, wherein the lower contact has a higher spring rate at the first mating interface and a lower spring rate at the second mating interface.

2. The card edge connector of claim 1, wherein the lower contacts are shifted forward relative to the upper contacts such that the first and second mating interfaces of the lower contacts are offset with respect to the first and second mating interfaces of the upper contacts.

3. The card edge connector of claim 1, wherein the lower wall is angled nonparallel to the mounting end of the housing to define an angled card slot configured to receive the circuit card in an angled loading direction nonparallel to the host circuit board.

4. The card edge connector of claim 1, wherein the first and second mating interfaces of the lower contacts are arranged along a lower mating plane and the first and second mating interfaces of the upper contacts are arranged along an upper mating plane parallel to the lower mating plane, the card slot being configured to receive the circuit card in a loading direction angled nonparallel to the upper mating plane and the lower mating plane.

5. The card edge connector of claim 1, further comprising a fastener securely coupled to the housing to secure the circuit card to the housing.

6. The card edge connector of claim 1, wherein the housing includes first and second side walls at first and second sides of the card slot, the first and second side walls including guide channels to guide loading of the circuit card into the card slot.

7. The card edge connector of claim 6, wherein the guide channels are angled nonparallel to the mounting end of the housing.

8. The card edge connector of claim 1, wherein the lower wall includes guide pads at a front of the guide slot, the guide pads configured to position the circuit card above the lower wall during loading of the circuit card into the card slot.

9. The card edge connector of claim 8, wherein the guide pads are positioned forward of the first and second mating interfaces of the lower contacts to support the circuit card relative to the lower contacts during loading of the circuit card into the card slot.

10. The card edge connector of claim 1, wherein the housing includes guide wings at first and second sides of the mating end forward of the card slot for guiding the circuit card into the card slot.

11. The card edge connector of claim 1, wherein the upper contact includes a base between the mating end and the mounting end of the upper contact, the mating end of the upper contact being cantilevered from the base of the upper contact with a support arm of the upper contact extending from the base of the upper contact and a spring arm extending from the support arm of the upper contact, the spring arm of the upper contact being folded under the support arm of the upper contact and defining the first and second mating interfaces of the upper contact, and wherein the lower contact includes a base between the mating end and the mounting end of the lower contact, the mating end of the lower contact being cantilevered from the base of the lower contact with a support arm of the lower contact extending from the base of the lower contact and a spring arm extending from the support arm of the lower contact, the spring arm of the lower contact being folded under the support arm of the lower contact and defining the first and second mating interfaces of the lower contact.

12. The card edge connector of claim 11, wherein the support arm of the upper contact is flexed relative to the base of the upper contact and the spring arm of the upper contact is flexed toward the support arm of the upper contact when mated with the circuit card, and wherein the support arm of the lower contact is flexed relative to the base of the lower contact and the spring arm of the lower contact is flexed toward the support arm of the lower contact when mated with the circuit card.

13. A card edge connector system comprising:

a circuit card having a mating end including a mating edge between an upper surface and a lower surface, the circuit card having upper contact pads on the upper surface and lower contact pads on the lower surface; and a card edge connector configured to be mounted to a host circuit board, the card edge connector comprising a housing having a card slot receiving the circuit card, the housing holding upper contacts and lower contacts configured to be terminated to the host circuit board, the upper contacts including mating ends mated with corresponding upper contact pads, each mating end having a first mating interface and a second mating interface non-continuous with the first mating interface and remote from the first mating interface defining first and second points of contact with the same upper contact pad, the lower contacts including mating ends mated with corresponding lower contact pads, each mating end having a first mating interface and a second mating interface non-continuous with the first mating interface and remote from the first mating interface defining first and second points of contact with the same lower contact pad;

wherein the circuit card is received in the card slot of the housing in a loading direction angled non-parallel to the host circuit board to a loaded position, the circuit card being rotated in a mating direction within the card slot toward the host circuit board to a mated position, the first and second points of contact of the upper contacts being offset in a plane non-parallel to the loading direction and the first and second points of contact of the lower contacts being offset in a plane non-parallel to the loading direction, the first and second points of contact of the upper contacts being offset from the first and second points of contact of the lower contacts, respectively, wherein at least one of the first mating interface or the second mating interface of each upper contact is separate from the upper contact pads of the circuit card in the loaded position and at least one of the first mating interface or the second mating interface of each lower contact is separate from the lower contact pads of the circuit card in the loaded position, and wherein the first and second mating interfaces of each of the upper contacts and the lower contacts being moved into engagement with the upper contact pads and the lower contact pads as the circuit card is moved from the loaded position to the mated position, the circuit card being held in the card slot in the mated position with the circuit card extending from the housing parallel to the host circuit board.

14. The card edge connector system of claim 13, wherein the upper contact has a higher spring rate at the first mating interface and a lower spring rate at the second mating interface, and wherein the lower contact has a higher spring rate at the first mating interface and a lower spring rate at the second mating interface.

15. The card edge connector system of claim 13, wherein the lower wall is angled nonparallel to the mounting end of the housing to define an angled card slot receiving the circuit card in the angled loading direction.

16. The card edge connector system of claim 13, further comprising a fastener securely coupled to the housing to secure the circuit card to the housing.

17. The card edge connector system of claim 13, wherein the lower wall includes guide pads at a front of the guide slot, the guide pads configured to position the circuit card above the lower wall during loading of the circuit card into the card slot.

18. A card edge connector system comprising:

a circuit card having a mating end including a mating edge between an upper surface and a lower surface, the circuit card having upper contact pads on the upper surface and lower contact pads on the lower surface, the circuit card having a fastener opening extending therethrough, the circuit card including pockets; and a card edge connector configured to be mounted to a host circuit board, the card edge connector comprising a housing having a card slot receiving the circuit card, the housing having a fastener opening extending into the housing proximate to the card slot, the housing holding upper contacts and lower contacts configured to be terminated to the host circuit board, the upper contacts including mating ends mated with corresponding upper contact pads, each mating end having a first mating interface and a second mating interface non-continuous with the first mating interface and remote from the first mating interface defining first and second points of contact with the same upper contact pad, the lower contacts including mating ends mated with corresponding lower contact pads, each mating end having a first mating interface and a second mating interface non-continuous with the first mating interface and remote from the first mating interface defining first and second points of contact with the same lower contact pad, the housing including guide pads at a front of the guide slot, the guide pads are positioned forward of the lower contacts to support the circuit card at a position above the lower contacts during loading of the circuit card into the card slot;

wherein the circuit card is secured to the housing of the card edge connector using a fastener separate and discrete from the housing and from the circuit card, the fastener being received in the fastener opening in the circuit card and the fastener opening in the housing to fix the circuit card to the housing; and wherein the pockets of the circuit card receive the guide pads when the circuit card is fully received in the card slot to lower the circuit card downward into mating engagement with the lower contacts.

19. The card edge connector system of claim 18, wherein the upper contact has a higher spring rate at the first mating interface and a lower spring rate at the second mating interface, and wherein the lower contact has a higher spring rate at the first mating interface and a lower spring rate at the second mating interface.

* * * * *